US009778588B2

(12) United States Patent
Rokutan et al.

(10) Patent No.: US 9,778,588 B2
(45) Date of Patent: Oct. 3, 2017

(54) CLEANING MEMBER, PROCESS CARTRIDGE, AND IMAGE FORMING APPARATUS

(71) Applicant: FUJI XEROX CO., LTD., Tokyo (JP)

(72) Inventors: Minoru Rokutan, Kanagawa (JP); Fuyuki Kano, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/205,618

(22) Filed: Jul. 8, 2016

(65) Prior Publication Data

US 2017/0212468 A1 Jul. 27, 2017

(30) Foreign Application Priority Data

Jan. 27, 2016 (JP) ..... 2016-013401

(51) Int. Cl.
*G03G 21/00* (2006.01)
*G03G 15/02* (2006.01)

(52) U.S. Cl.
CPC ..... *G03G 15/0225* (2013.01)

(58) Field of Classification Search
None
See application file for complete search history.

(56) References Cited

U.S. PATENT DOCUMENTS

2007/0177891 A1* 8/2007 Honobe ..... G03G 15/0225 399/100
2013/0089354 A1* 4/2013 Kano ..... G03G 15/0225 399/100

FOREIGN PATENT DOCUMENTS

JP 2013-50552 A 3/2013
JP 2013-152493 A 8/2013

* cited by examiner

*Primary Examiner* — Thomas Giampaolo, II
(74) *Attorney, Agent, or Firm* — Sughrue Mion, PLLC

(57) ABSTRACT

A cleaning member includes a core and an elastic layer disposed on an outer peripheral surface of the core. A circumferential cover length over which the elastic layer covers the core in a circumferential direction is greater at least at one of first and second end portions in an axial direction of the core than at a central portion in the axial direction. The central portion in the axial direction extends from one end to the other end of the core in the axial direction. When the cleaning member is rotated by a member to be cleaned, a non-contact region in which the first and second end portions in the axial direction are not in contact with the member to be cleaned is in a range from approximately 0° to approximately 15° in terms of a rotation angle of the cleaning member viewed from one side in the axial direction.

11 Claims, 10 Drawing Sheets

CLEANING MEMBER, PROCESS CARTRIDGE, AND IMAGE FORMING APPARATUS

CROSS-REFERENCE TO RELATED APPLICATIONS

This application is based on and claims priority under 35 USC 119 from Japanese Patent Application No. 2016-013401 filed Jan. 27, 2016.

BACKGROUND

Technical Field

The present invention relates to a cleaning member, a process cartridge, and an image forming apparatus.

SUMMARY

According to an aspect of the invention, there is provided a cleaning member including a core and an elastic layer disposed on an outer peripheral surface of the core. A circumferential cover length over which the elastic layer covers the core in a circumferential direction is greater at least at one of a first end portion and a second end portion of the elastic layer in an axial direction of the core than at a central portion of the elastic layer in the axial direction of the core, and the central portion of the elastic layer in the axial direction of the core extends from one end to the other end of the core in the axial direction of the core. When the cleaning member is rotated by a member to be cleaned, a non-contact region in which the first end portion and the second end portion of the elastic layer in the axial direction of the core are not in contact with the member to be cleaned is in a range from approximately 0° to approximately 15° in terms of a rotation angle of the cleaning member viewed from one side in the axial direction of the core.

BRIEF DESCRIPTION OF THE DRAWINGS

An exemplary embodiment of the present invention will be described in detail based on the following figures, wherein.

DETAILED DESCRIPTION

Figure 1:
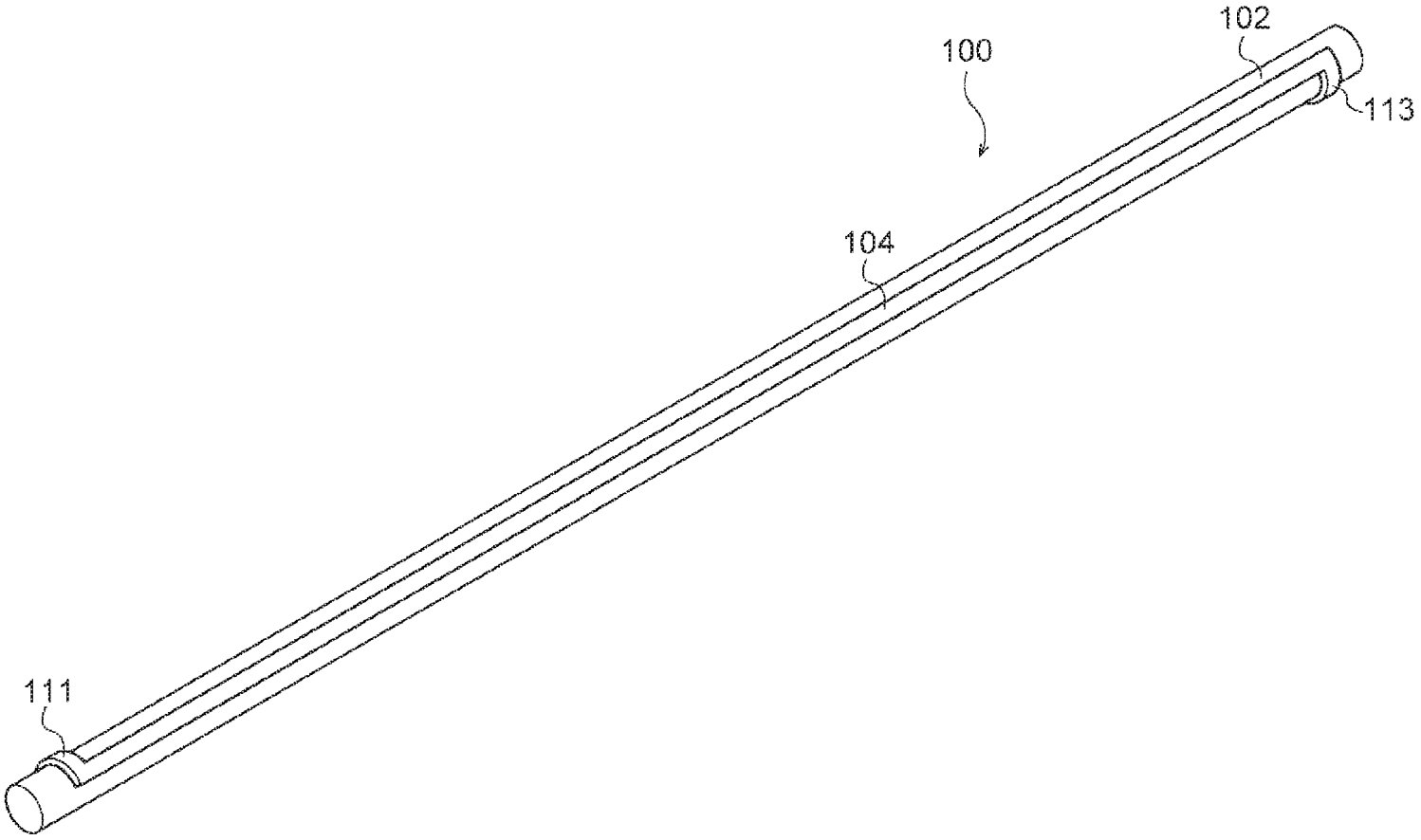
FIG. 1 is a schematic perspective view of a cleaning member according to an exemplary embodiment.

An exemplary embodiment of the present invention will now be described. Components having the same functions and effects are denoted by the same reference numerals throughout the drawings, and the description thereof may be omitted.

Cleaning Member

Figure 2:
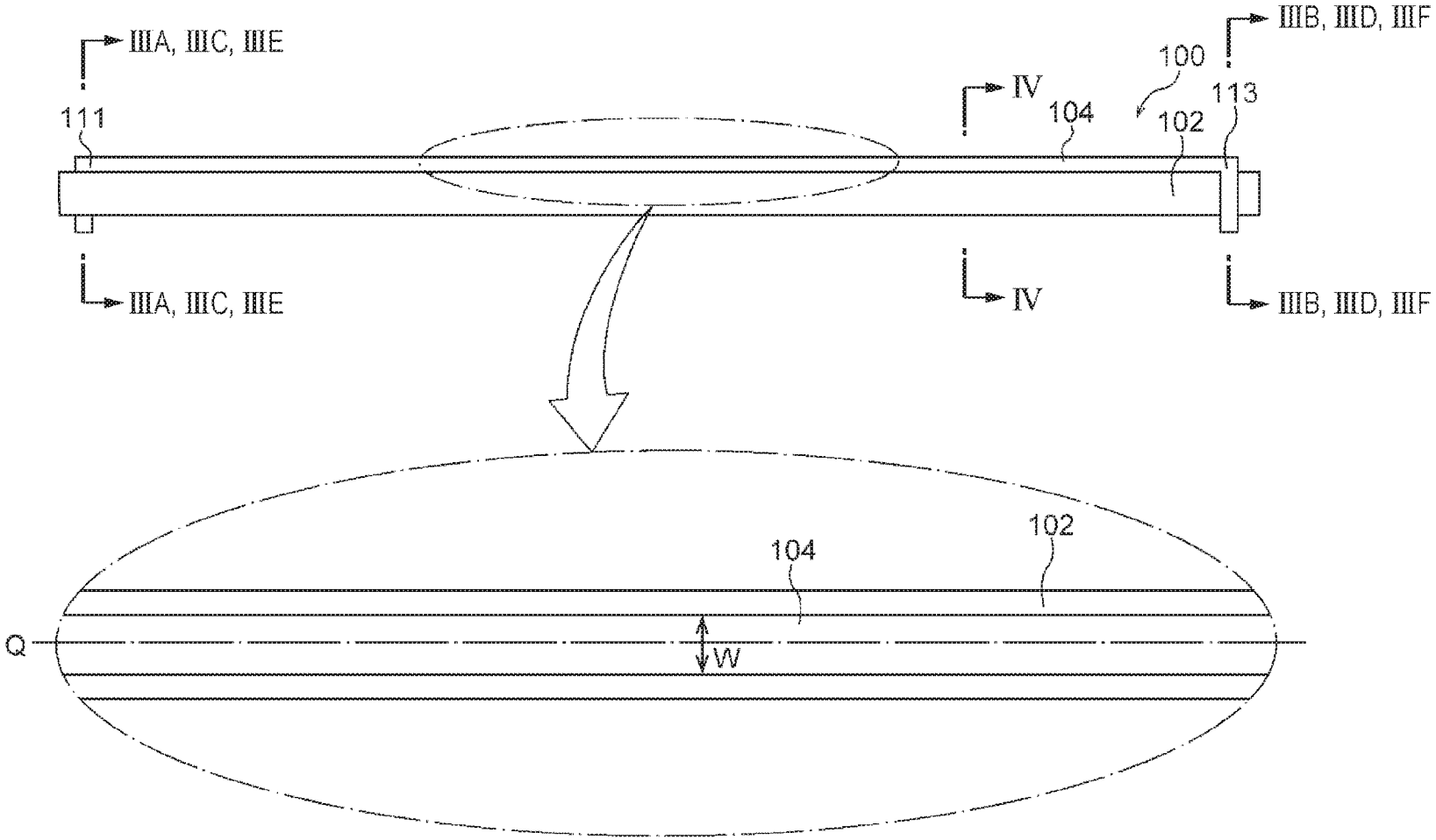
FIG. 2 shows a schematic plan view of the cleaning member according to the exemplary embodiment.
Figure 3A:
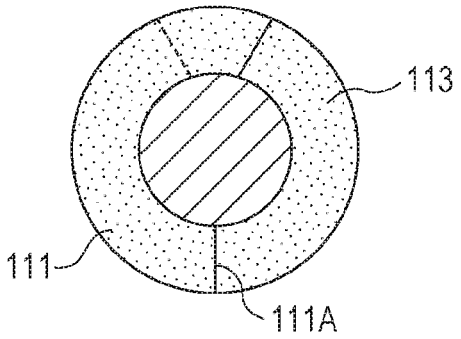
FIG. 3A is a schematic sectional view of a first end portion of the cleaning member according to the exemplary embodiment.
Figure 3D:
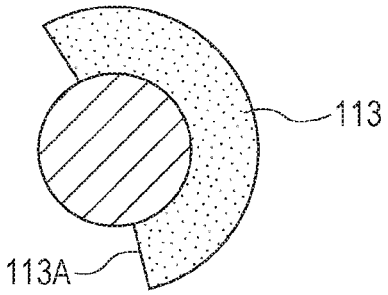
FIG. 3D is a schematic sectional view of a second end portion of the cleaning member according to the exemplary embodiment.
Figure 3B:
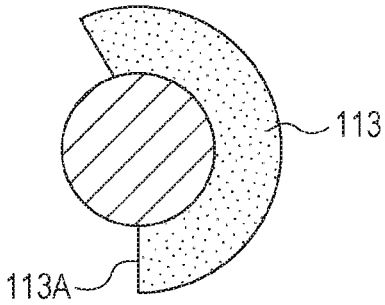
FIG. 3B is a schematic sectional view of a second end portion of the cleaning member according to the exemplary embodiment.
Figure 3E:
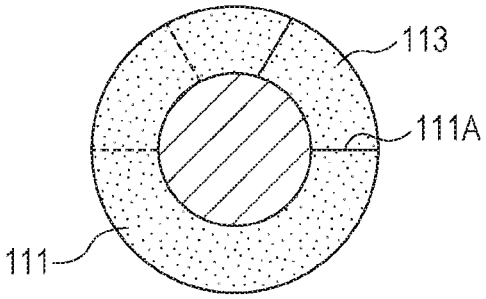
FIG. 3E is a schematic sectional view of a first end portion of the cleaning member according to the exemplary embodiment.
Figure 3C:
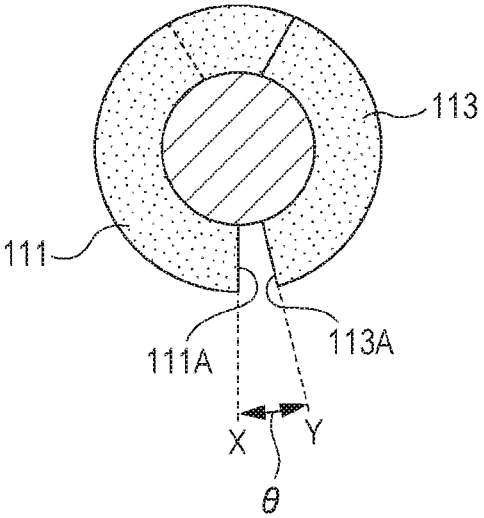
FIG. 3C is a schematic sectional view of a first end portion of the cleaning member according to the exemplary embodiment.
Figure 3F:
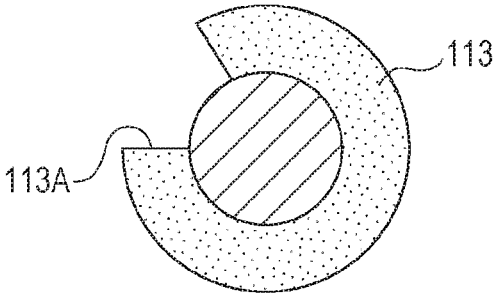
FIG. 3F is a schematic sectional view of a second end portion of the cleaning member according to the exemplary embodiment.

FIG. 1 a schematic perspective view of a cleaning member 100 according to the exemplary embodiment. FIG. 2 shows a schematic plan view of the cleaning member 100 according to the exemplary embodiment. FIG. 2 also shows an enlarged plan view seen from above an elastic layer 104. FIGS. 3A to 3F are schematic sectional views of end portions of the elastic layer 104 of the cleaning member 100 according to the exemplary embodiment. More specifically, FIGS. 3A, 3C, and 3E are sectional views of the cleaning member 100 taken along line IIIA, IIIC, IIIE-IIIA, IIIC, IIIE in FIG. 2, that is, sectional views in which a first end portion 111 of the elastic layer 104 is sectioned in the circumferential direction of a core 102. FIGS. 3B, 3D, and 3F are sectional views of the cleaning member 100 taken along line IIIB, IIID, IIIF-IIIB, IIID, IIIF in FIG. 2, that is, sectional views in which a second end portion 113 of the elastic layer 104 is sectioned in the circumferential direction of the core 102.

Figure 4:
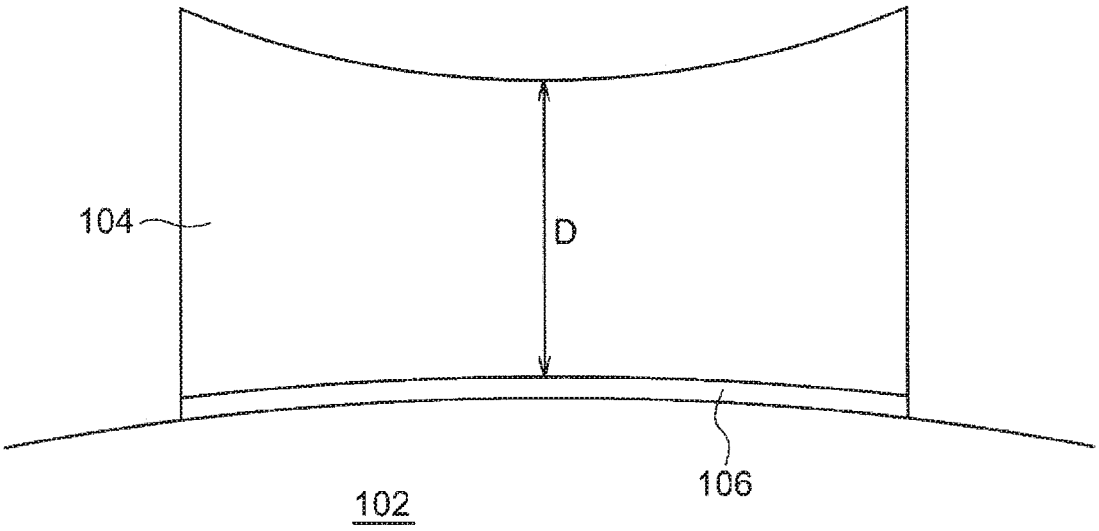
FIG. 4 is an enlarged sectional view of an elastic layer of the cleaning member according to the exemplary embodiment.

FIG. 4 is an enlarged sectional view of the elastic layer 104 of the cleaning member 100 according to the present exemplary embodiment. FIG. 4 is a sectional view of the elastic layer 104 taken along line IV-IV in FIG. 2, that is, in the circumferential direction of the core 102.

As illustrated in FIGS. 1 to 4, the cleaning member 100 according to the present exemplary embodiment is, for example, a roll-shaped member including the core 102, the elastic layer 104, and an adhesive layer 106 that bonds the core 102 and the elastic layer 104 together.

The elastic layer 104 is disposed on the outer peripheral surface of the core 102. The elastic layer 104 includes, for example, a strip-shaped elastic member 108 (see FIGS. 7A and 7B: hereinafter also referred to as "strip 108") that extends from one end to the other end of the core 102 in the axial direction thereof in a central portion of the elastic layer 104. The elastic layer 104 is formed such that a circumferential cover length, which is a length over which the elastic layer 104 covers the core 102 in the circumferential direction, is greater at the first end portion 111 and the second end portion 113 than at the central portion in the axial direction of the core 102.

FIG. 3A is a sectional view of the first end portion 111 of the elastic layer 104 taken in the circumferential direction of the core 102 and viewed in the direction from the first end to the second end in the axial direction of the core 102. FIG. 3B is a sectional view of the second end portion 113 of the elastic layer 104 taken in the circumferential direction of the core 102 and viewed in the direction from the first end to the second end in the axial direction of the core 102.

Referring to FIG. 3A, the first end portion 111 of the elastic layer 104 covers a portion of the right semicircular segment and the left semicircular segment of the core 102 in FIG. 3A. The second end portion 113 of the elastic layer 104 is visible in a region in which the core 102 is not covered by the first end portion 111 of the elastic layer 104. Referring to FIG. 3B, the second end portion 113 of the elastic layer 104 covers a portion of the left semicircular segment and the right semicircular segment of the core 102 in FIG. 3B. As illustrated in FIGS. 3A and 3B, the length over which the elastic layer 104 covers the core 102 in the circumferential direction is greater than or equal to ½ of the circumference of the core 102 at each of the first end portion 111 and the second end portion 113.

When viewed in the direction from the first end to the second end in the axial direction of the core 102, an edge 111A of the first end portion 111 of the elastic layer 104 and an edge 113A of the second end portion 113 of the elastic layer 104 overlap.

More specifically, the boundary between a region in which the first end portion 111 comes into contact with a member to be cleaned and a region in which the first end portion 111 does not come into contact with the member to be cleaned at the edge 111A of the first end portion 111 overlaps the boundary between a region in which the second end portion 113 comes into contact with the member to be cleaned and a region in which the second end portion 113 does not come into contact with the member to be cleaned at the edge 113A of the second end portion 113.

FIGS. 3C and 3D are sectional views of the first end portion 111 and the second end portion 113, respectively, of another example of the elastic layer 104 included in the cleaning member 100 according to the present exemplary embodiment taken in the circumferential direction of the core 102.

Referring to FIG. 3C, the first end portion 111 of the elastic layer 104 covers a portion of the right semicircular segment and the left semicircular segment of the core 102 in FIG. 3C. The second end portion 113 of the elastic layer 104 is visible in a region in which the core 102 is not covered by the first end portion 111 of the elastic layer 104. Referring to FIG. 3D, the second end portion 113 of the elastic layer 104 covers a portion of the left semicircular segment and a portion of the right semicircular segment of the core 102 in FIG. 3D. As illustrated in FIGS. 3C and 3D, the length over which the elastic layer 104 covers the core 102 in the circumferential direction is greater than or equal to ½ of the circumference of the core 102 at each end portion.

In this example, when viewed in the direction from the first end to the second end in the axial direction of the core 102, the edge 111A of the first end portion 111 and the edge 113A of the second end portion 113 do not overlap. In other words, there is a region in which neither of the end portions of the elastic layer 104 covers the core 102 in the circumferential direction.

FIGS. 3E and 3F are sectional views of the first end portion 111 and the second end portion 113, respectively, of another example of the elastic layer 104 included in the cleaning member 100 according to the present exemplary embodiment taken in the circumferential direction of the core 102.

Referring to FIG. 3E, the first end portion 111 of the elastic layer 104 covers a portion of the right semicircular segment, the left semicircular segment, and another portion of the right semicircular segment of the core 102 in FIG. 3E. The second end portion 113 of the elastic layer 104 is visible in a region in which the core 102 is not covered by the first end portion 111 of the elastic layer 104. Referring to FIG. 3F, the second end portion 113 of the elastic layer 104 covers a portion of the left semicircular segment, the right semicircular segment, and another portion of the left semicircular segment of the core 102 in FIG. 3F. Referring to FIGS. 3E and 3F, the length over which the elastic layer 104 covers the 102 in the circumferential direction is greater than or equal to ½ of the circumference of the core 102 at each of the first end portion 111 and the second end portion 113.

When viewed in the direction from the first end to the second end in the axial direction of the core 102, the edge 111A of the first end portion 111 and the edge 113A of the second end portion 113 do not overlap. Regions in which the end portions of the elastic layer 104 cover the core 102 in the circumferential direction overlap.

Figure 10:
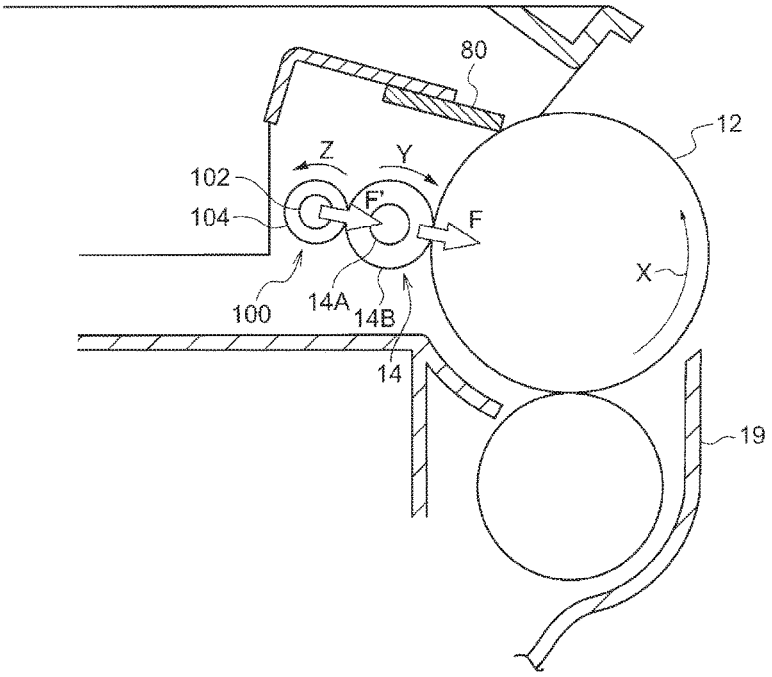
FIG. 10 is a schematic enlarged view of a section around a charging member (charging device) illustrated in FIGS. 8 and 9.

Referring to FIG. 10, when the member to be cleaned is a charging member 14, for example, a load F is applied to both ends of a conductive core 14A so that the charging member 14 is pressed against a photoconductor 12 and elastically deformed along the peripheral surface of an elastic foam layer 14B so as to form a nipping portion. In addition, a load F' is applied to both ends of the core 102 so that the cleaning member 100 is pressed against the charging member 14 and the elastic layer 104 is elastically deformed along the peripheral surface of the charging member 14 so as to form a nipping portion. Thus, the nipping portions that extend in the axial direction of the charging member 14 and the photoconductor 12 are formed while bending of the charging member 14 is suppressed. The cleaning member 100 is rotated in the direction of arrow Z by the rotation of the charging member 14.

The cleaning member 100 may be structured such that the elastic layer 104 is disposed on the core 102 so as to extend in the axial direction of the core 102 from one end to the other end of the core 102. In this case, the elastic layer 104 has a non-contact region in which the first end portion 111 and the second end portion 113 in the axial direction of the core 102 are not in contact with the charging member 14 when the cleaning member 100 is rotated by the charging member 14. When the non-contact region is large, the first end portion 111 and the second end portion 113 of the elastic layer 104 easily slip relative to the charging member 14, and the cleaning member 100 cannot be easily rotated by the charging member 14. Accordingly, adhesion of toner or the like to the member to be cleaned (filming of toner or the like, which is hereinafter referred to simply as "filming") may occur on the surface of the charging member 14. As a result, the image density becomes uneven.

In this specification, the non-contact region is a region in which neither of the first end portion 111 and the second end portion 113 of the elastic layer 104 is in contact with the member to be cleaned (for example, the charging member 14) when the cleaning member 100 is rotated by the member to be cleaned. More specifically, the non-contact region is a region in which neither of the end portions of the elastic layer 104 covers the core 102 in the circumferential direction, as illustrated in FIG. 3C.

In this specification, the "central region" of the elastic layer 104 is a portion of the elastic layer 104 excluding the first end portion 111 and the second end portion 113.

In the cleaning member 100 according to the present exemplary embodiment, the non-contact region, in which the first end portion 111 and the second end portion 113 of the elastic layer 104 in the axial direction of the core 102 are not in contact with the member to be cleaned when the cleaning member 100 is rotated by the member to be cleaned, is in the range from 0° to 15° or from approximately 0° to approximately 15° in terms of the rotation angle of the cleaning member 100 viewed from one side in the axial direction of the core 102.

As described above, in the example illustrated in FIGS. 3C and 3D, the cleaning member 100 is configured such that the region in which the first end portion 111 of the elastic layer 104 covers the core 102 and the region in which the second end portion 113 of the elastic layer 104 covers the core 102 do not overlap except for the region in which a portion of the elastic layer 104 extends in the axial direction of the core 102. Accordingly, the edge 111A of the first end portion 111 and the edge 113A of the second end portion 113 do no overlap. Therefore, there is a region in which the end portions of the elastic layer 104 do not cover the core 102 in the circumferential direction.

In this case, there is a non-contact region in which neither of the first end portion 111 and the second end portion 113 of the elastic layer 104 is in contact with the charging member 14 when the cleaning member 100 is rotated by the charging member 14.

When the rotation angle viewed from one side in the axial direction of the core 102 is greater than 15°, the non-contact region is too large. Therefore, the cleaning member 100 cannot be rotated by inertia, and it becomes difficult for the cleaning member 100 to follow the charging member 14. Since it becomes difficult to ensure sufficient ability of the cleaning member 100 to follow the charging member 14, the first end portion 111 and the second end portion 113 of the elastic layer 104 easily slip relative to the charging member 14, and filming easily occurs. Accordingly, the image density is easily reduced.

In the case where the rotation angle viewed from one side in the axial direction of the core 102 is less than or equal to 15°, even if there is a non-contact region when the cleaning member 100 is rotated by the charging member 14, the cleaning member 100 is rotated by inertia and follows the rotation of the charging member 14. Thus, the cleaning member 100 has sufficient ability to follow the rotation of the charging member 14. The occurrence of slipping of the first end portion 111 and the second end portion 113 of the elastic layer 104 relative to charging member 14 is suppressed, and the occurrence of filming is suppressed as a result. Therefore, the occurrence of unevenness in the image density is suppressed.

Accordingly, it is inferred that the cleaning member 100 according to the present exemplary embodiment having the above-described structure is capable of suppressing the occurrence of unevenness in the image density.

The cleaning member 100 according to the present exemplary embodiment is structured such that the above-described circumferential cover length is greater at least at one of the first end portion 111 and the second end portion 113 of the elastic layer 104 than at the central portion of the elastic layer 104 in the axial direction of the core 102. With this structure, the occurrence of separation of the elastic layer 104 from the core 102 is also easily suppressed.

Since the central portion of the elastic layer 104 is arranged so as to extend from one end to the other end of the core 102 in the axial direction of the core 102, the cleaning member 100 according to the present exemplary embodiment has high cleaning performance. This is probably because when the cleaning member 100 is rotated by the member to be cleaned and a portion of the elastic layer 104 that extends in the longitudinal direction comes into contact with the member to be cleaned, the portion of the elastic layer 104 that extends in the longitudinal direction is at a small angle with respect to the axial direction of the member to be cleaned. Furthermore, when the elastic layer 104 has the above-described structure, the amount of the material is reduced, and the material cost is reduced accordingly.

The "rotation angle of the cleaning member viewed from one side in the axial direction of the core" according to this specification will now be described. Assume that a cross section of the first end portion of the elastic layer taken in the circumferential direction of the core so as to pass through a region where the first end portion projects most in the circumferential direction of the core and a cross section of the second end portion of the elastic layer taken in the circumferential direction of the core so as to pass through a region where the second end portion projects most in the circumferential direction of the core are superposed as viewed from one side in the axial direction of the core. In this state, the "rotation angle of the cleaning member viewed from one side in the axial direction of the core" is the angle between the straight line that passes through the boundary between a region in which the first end portion comes into contact with the member to be cleaned and a region in which the first end portion does not come into contact with the member to be cleaned and the center of the core and the straight line that passes through the boundary between a region in which the second end portion comes into contact with the member to be cleaned and a region in which the second end portion does not come into contact with the member to be cleaned and the center of the core.

For example, referring to FIG. 3C, a cross section of the first end portion 111 of the elastic layer 104 taken in the circumferential direction of the core 102 so as to pass through a region where the first end portion 111 projects most in the circumferential direction and a cross section of the second end portion 113 of the elastic layer 104 taken in the circumferential direction of the core 102 so as to pass through a region where the second end portion 113 projects most in the circumferential direction are superposed as viewed from one side in the axial direction of the core 102. In this state, when observed in the direction from the first end portion 111 to the second end portion 113, the above-described rotation angle is the angle θ between the line X that extends from the boundary between a region in which the first end portion 111 comes into contact with the member to be cleaned and a region in which the first end portion 111 does not come into contact with the member to be cleaned toward the center of the core 102 and the line Y that extends from the boundary between a region in which the second end portion 113 comes into contact with the member to be cleaned and a region in which the second end portion 113 does not come into contact with the member to be cleaned toward the center of the core 102.

Referring to FIGS. 3E and 3F, when the region in which the first end portion 111 of the elastic layer 104 covers the core 102 and the region in which the second end portion 113 of the elastic layer 104 covers the core 102 overlap, one or both of the first end portion 111 and the second end portion 113 of the elastic layer 104 are in contact with the charging member 14 when the cleaning member 100 is rotated by the charging member 14. Therefore, the above-described non-contact region is not provided. In this case, since the non-contact region is not provided, the rotation angle viewed from one side in the axial direction of the core 102 (angle θ) is 0°.

In the cleaning member 100 according to the present exemplary embodiment, the rotation angle viewed from one side in the axial direction of the core 102 (angle θ) is 15° or less or approximately 15° or less. To further suppress the occurrence of unevenness in the image density, the rotation angle viewed from one side in the axial direction of the core 102 (angle θ) may be 10° or less or approximately 10° or less, more preferably 5° or less or approximately 5° or less, and still more preferably, 0°.

As described above, in the cleaning member 100 according to the present exemplary embodiment illustrated in FIGS. 3A and 3B, the edge 111A of the first end portion 111 and the edge 113A of the second end portion 113 overlap. In this case, the rotation angle viewed from one side in the axial direction of the core 102 (angle θ) is 0°. In the case where this angle is 0°, one of the first end portion 111 and the second end portion 113 is in contact with the charging member 14 when the cleaning member 100 is rotated by the charging member 14. Therefore, the non-contact region is not provided. Accordingly, the cleaning member 100 has sufficient ability to follow the charging member 14, and the occurrence of filming is easily suppressed. As a result, the occurrence of unevenness in the image density is further suppressed.

In addition, as described above, when the cleaning member 100 according to the present exemplary embodiment illustrated in FIGS. 3E and 3F is observed in the direction from the first end portion 111 to the second end portion 113 along the axial direction of the core 102, and when the first end portion 111 and the second end portion 113 of the elastic layer 104 are superposed, the non-contact region is not provided and the regions in which the elastic layer 104 covers the core 102 in the circumferential direction overlap.

In this case, when the cleaning member 100 is rotated by the charging member 14, the circumferential cover length over which the core 102 is covered in the circumferential direction is long at both end portions of the elastic layer 104. Therefore, the frictional force between the elastic layer 104 and the charging member 14 is easily increased, and the ability of the cleaning member 100 to follows the rotation of the charging member 14 is easily improved. Accordingly, the occurrence of slipping is further suppressed, and therefore the occurrence of filming is further suppressed. As a result, the occurrence of unevenness in the image density may be further suppressed.

When the circumferential cover length of the elastic layer 104 is greater than or equal to ½ or approximately ½ of the circumference of the core 102 at least at one of the first end portion 111 and the second end portion 113 in the axial direction, the occurrence of unevenness in the image density may be further suppressed. Furthermore, when the circumferential cover length is greater than or equal to ½ or approximately ½ of the circumference of the core 102 at least at one of the first end portion 111 and the second end portion 113 in the axial direction, not only is the occurrence of unevenness in the image density further suppressed, but the ability of the cleaning member 100 to follow the charging member 14 may be easily balanced between the end portions of the elastic layer 104.

Furthermore, when the regions in which the end portions of the elastic layer 104 cover the core 102 overlap in a cross section of the second end portion 113 of the elastic layer 104 taken in the circumferential direction of the core 102 and viewed in the direction from the first end to the second end along the axial direction, the occurrence of unevenness in the image density may be further suppressed.

Here, the "circumferential cover length" is the maximum length over which the elastic layer 104 covers the outer peripheral surface of the core 102 in the circumferential direction.

Although the first end portion 111 and the second end portion 113 of the elastic layer 104 have been described with reference to FIGS. 3A to 3F, the end portions are not limited to this. There is no particular limitation regarding the end portions of the elastic layer 104 as long as the non-contact region in which the first end portion 111 and the second end portion 113 of the elastic layer 104 are not in contact with the charging member 14 is 15° or less or approximately 15° or less in terms of the rotation angle viewed from one side in the axial direction of the core 102.

A charging device, a transfer device, a unit for an image forming apparatus, a process cartridge, and an image forming apparatus including the cleaning member 100 having the above-described structure are capable of suppressing a reduction in performance due to insufficient cleaning of a member to be cleaned, such as a charging member or a transfer member.

The individual components will now be described.

First, the core 102 will be described.

The material of the core 102 may be a metal, an alloy, or a resin.

Examples of the metal or alloy include metals such as iron (for example, free-machining steel), copper, brass, aluminum, and nickel, and alloys such as stainless steel.

Examples of the resin include polyacetal resin; polycarbonate resin; acrylonitrile-butadiene-styrene copolymer; polypropylene resin; polyester resin; polyolefin resin; polyphenylene ether resin; polyphenylene sulfide resin; polysulfone resin; polyether sulfone resin; polyarylene resin; polyether imide resin; polyvinyl acetal resin; polyketone resin; polyether ketone resin; polyether ether ketone resin; polyaryl ketone resin; polyether nitrile resin; liquid crystal resin; polybenzimidazole resin; polyparabanic acid resin; vinyl polymer or copolymer obtained by polymerizing or copolymerizing one or more vinyl monomers selected from a group including aromatic alkenyl compound, methacrylic acid ester, acrylic acid ester, and vinyl cyanide compound; diene-aromatic alkenyl compound copolymer; vinyl cyanide-diene-aromatic alkenyl compound copolymer; aromatic alkenyl compound-diene-vinyl cyanide-N-phenyl maleimide copolymer; vinyl cyanide-(ethylene-diene-propylene (EPDM))-aromatic alkenyl compound copolymer; polyolefin resin; vinyl chloride resin; and chlorinated vinyl chloride resin. These resins may be used individually or in combination.

The material, surface processing method, etc., may be selected as necessary. In particular, when the core 102 is made of a metal, the core 102 may be plated. When an electrically non-conductive material, such as a resin, is used, the material may be subjected to a typical process for imparting electrical conductivity, such as plating, or be used as is.

The elastic layer 104 will now be described.

The elastic layer 104 is a layer made of a material that returns to its original shape after being deformed by application of external force of 100 Pa. The elastic layer 104 may either be an elastic foam layer or a non-foamed elastic layer. The elastic layer 104 may be composed of an elastic foam layer to increase the cleaning performance. The elastic foam layer is a layer made of a material having voids, in other words, a foamed material.

Examples of the material of the elastic layer 104 include foaming resins such as polyurethane, polyethylene, polyamide, and polypropylene, rubber materials such as silicone rubber, fluorine rubber, urethane rubber, ethylene propylene diene rubber (EPDM), acrylonitrile-butadiene rubber (NBR), chloroprene rubber (CR), chlorinated polyisoprene, isoprene, styrene-butadiene rubber, hydrogenated polybutadiene, or butyl rubber, or mixtures of two or more of these materials.

An assistant agent such as a foaming aid, a foam stabilizer, a catalyst, a curing agent, a plasticizer, or a vulcanization accelerator may be added to these materials.

In particular, the elastic layer 104 may be made of polyurethane foam having a high tensile strength to prevent damage to the member to be cleaned due to scratching and to prevent tearing and breaking over a long period of time.

Examples of the polyurethane foam include reaction products of a polyol (e.g., polyester polyol, polyether polyol, or acryl polyol) and an isocyanate (e.g., 2,4-tolylene diisocyanate, 2,6-tolylene diisocyanate, 4,4-diphenylmethane diisocyanate, tolidine diisocyanate, or 1,6-hexamethylene diisocyanate), and materials obtained by causing the reaction products to further react with a chain extender, such as 1,4-butanediol or trimethylol propane.

Foaming of polyurethane is generally performed by using, for example, water and a foaming agent such as an azo compound (e.g., azodicarbonamide or azobisisobutyronitrile).

An assistant agent such as a foaming aid, a foam stabilizer, or a catalyst may be added to the polyurethane foam.

In particular, the polyurethane foam may be an ether-based polyurethane foam because ester-based polyurethane foams have a tendency to deteriorate due to humidity and heat. A silicone oil foam stabilizer is typically used for ether-based polyurethanes. However, image defects caused by migration of silicone oil to the member to be cleaned (e.g., charging roller) may occur during storage (in particular, storage at high temperature and high humidity). The migration of the foam stabilizer to the member to be cleaned may be suppressed and image defects caused by the migration of the foam stabilizer may be reduced by using a foam stabilizer other than silicone oil.

Examples of the foam stabilizer other than silicone oil include Si-free organic surfactants (e.g., anionic surfactants such as dodecylbenzenesulfonic acid and sodium lauryl sulfate). A method that does not use a silicone foam stabilizer may also be employed.

Whether a foam stabilizer other than silicone oil is used to form the ether-based polyurethane foam is determined by examining whether Si is contained through componential analysis.

In the cleaning member 100 according to the present exemplary embodiment, the central portion of the elastic layer 104 is arranged so as to extend from one end to the other end of the core 102 in the axial direction of the core 102.

Referring to the enlarged plan view of FIG. 2, which is viewed from the side of the elastic layer 104, the arrangement in which the central portion of the elastic layer 104 extends in the axial direction of the core 102 means that the angle between the longitudinal direction of the elastic layer 104 and the axial direction Q of the core 102 is in the range of 3° or less. Thus, when the elastic layer 104 is arranged such that the central portion thereof extends from one end to the other end of the core 102 in the axial direction of the core 102, the allowance of the angle relative to the axial direction Q of the core 102 (core axial direction) is 3° or less.

To improve the cleaning performance of the cleaning member 100, the angle between the longitudinal direction of the elastic layer 104 and the axial direction Q of the core 102 may be 2° or less, more preferably 1° or less, and still more preferably, 0° or less. As the angle decreases, the distance over which the elastic layer 104 extends from one end to the other end decreases and the material cost of the elastic layer 104 decreases accordingly.

The thickness D of the elastic layer 104 (thickness of the central portion in the width direction) is preferably in the range from 1.0 mm to 15.0 mm, more preferably from 1.5 mm to 15 mm, and still more preferably from 2 mm to 5 mm.

The thickness D of the elastic layer 104 may be measured as follows.

The thickness profile of the elastic layer 104 is measured by scanning the cleaning member 100 in the longitudinal direction (axial direction) of the cleaning member 100 with a laser analyzer (Laser Scan Micrometer, model LSM 6200 produced by Mitsutoyo Corporation) at a traverse speed of 1 mm/s while the position of the cleaning member 100 in the circumferential direction is fixed. Subsequently, the position in the circumferential direction is shifted and the same measurement is performed (measurement is performed at three positions apart from each other by 120°). The thickness D of the elastic layer 104 is calculated on the basis of the determined profiles.

To suppress the occurrence of separation of the elastic layer 104 from the core 102, the circumferential cover length (W in FIG. 2) over which the elastic layer 104 covers the core 102 in the circumferential direction may be less than or equal to ½ or approximately ½ of the circumference of the core 102 at the central portion of the elastic layer 104 in the axial direction of the core 102. For the same reason, the circumferential cover length at the central portion is preferably less than or equal to ⅖, more preferably less than or equal to ⅓ or approximately ⅓, and still more preferably less than or equal to ¼ or approximately ¼ of the circumference of the core 102. The lower limit of the circumferential cover length depends on the circumference of the core 102, and is not particularly limited. However, to ensure sufficient bonding area, cleaning performance, and productivity of the cleaning member 100, the circumferential cover length may be greater than or equal to 1 mm.

Figure 5:
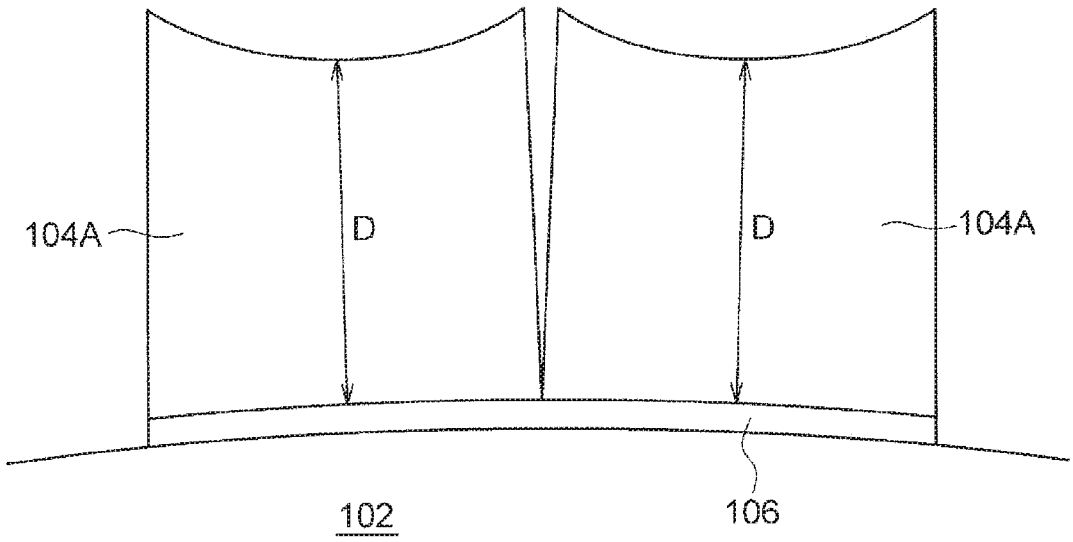
FIG. 5 is an enlarged sectional view of an elastic layer of the cleaning member according to the exemplary embodiment.
Figure 6:
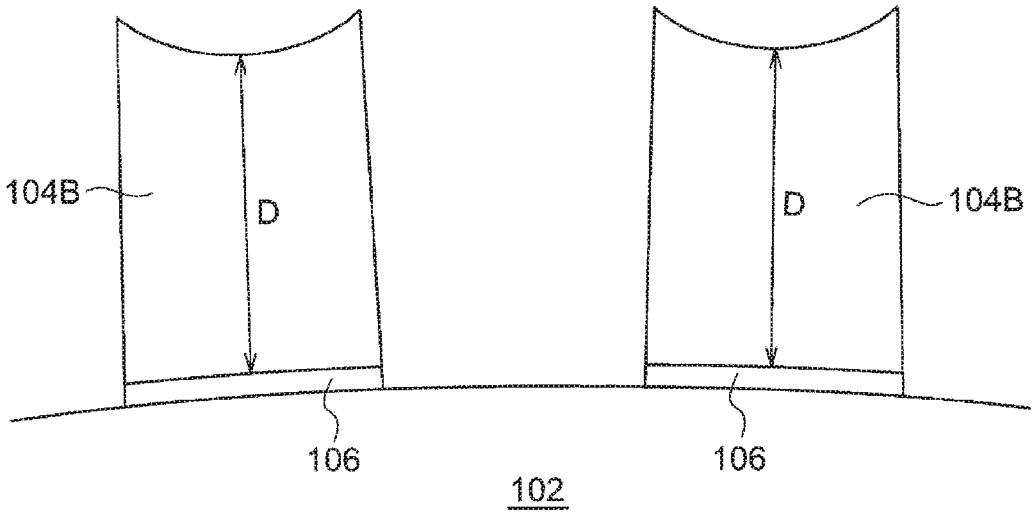
FIG. 6 is an enlarged sectional view of an elastic layer of the cleaning member according to the exemplary embodiment.

The elastic layer 104 is not limited to a layer composed of a single strip 108. For example, as illustrated in FIGS. 5 and 6, the elastic layer 104 may instead be elastic layers 104A and 104B formed of two or more strips 108 (strip-shaped elastic members) arranged so as to as to extend from one end to the other end of the core 102. When two or more strips 108 are arranged on the core 102 to form the elastic layers 104A and 104B, the cleaning performance of the cleaning member 100 may be easily increased.

The elastic layers formed of two or more strips 108 (strip-shaped elastic members) arranged on the outer peripheral surface of the core 102 may either be the elastic layers 104A (see FIG. 5) arranged such that longitudinal sides of adhesion surfaces of the strips 108 (surfaces of the strips 108 that face the outer peripheral surface of the core 102) are in contact with each other, or elastic layers 104B (see FIG. 6) arranged such that the longitudinal sides of the adhesion surfaces are not in contact with each other. Although not illustrated, the elastic layers may be formed of two strips 108 located so as to face each other in the radial direction with the core 102 provided therebetween.

The adhesive layer 106 will now be described.

There is no particular limitation regarding the adhesive layer 106 as long as the core 102 and the elastic layer 104 may be bonded to each other. For example, the adhesive layer 106 may be composed of a double-sided adhesive tape or other types of adhesives.

A method for manufacturing the cleaning member 100 according to the present exemplary embodiment will now be described.

Figure 7A:
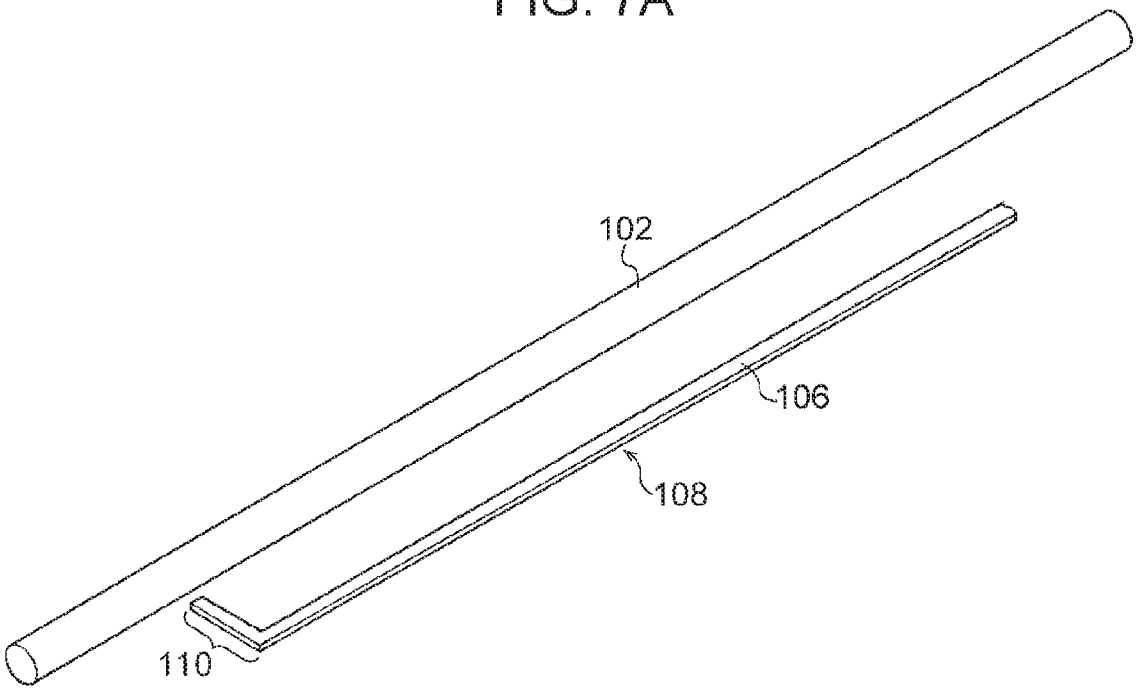
FIG. 7A illustrates a step of an example of a method for manufacturing the cleaning member according to the exemplary embodiment.
Figure 7B:
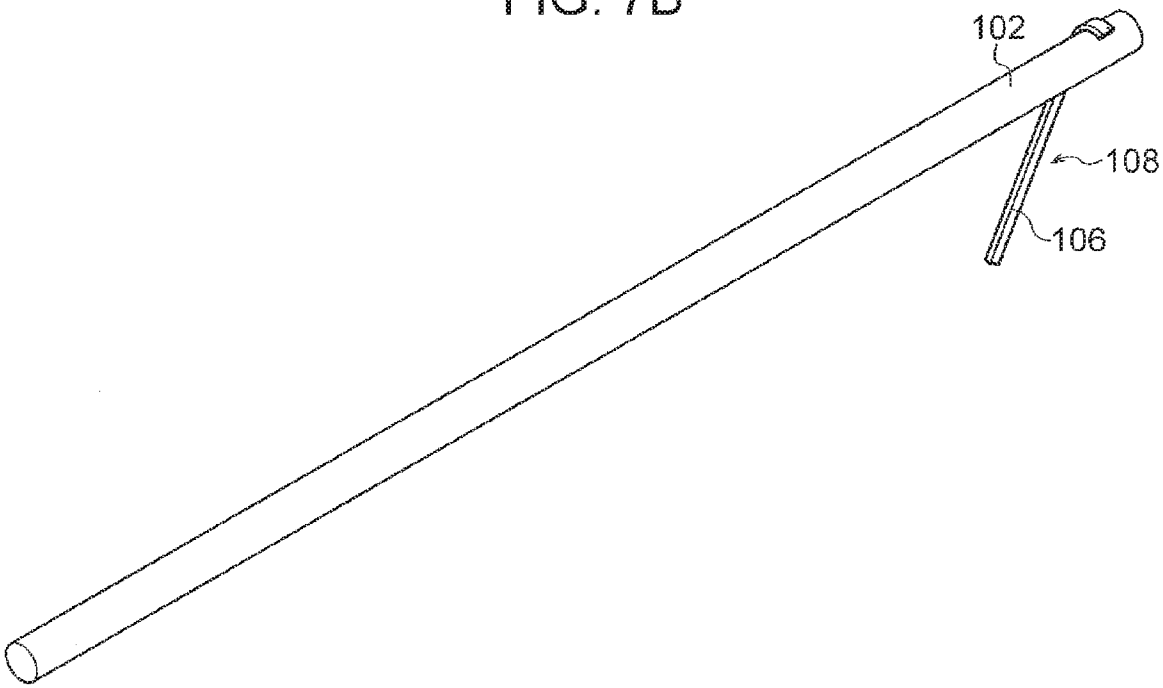
FIG. 7B illustrates a step of an example of a method for manufacturing the cleaning member according to the exemplary embodiment.

FIGS. 7A and 7B illustrate steps of an example of a method for manufacturing the cleaning member 100 according to the present exemplary embodiment.

First, as illustrated in FIG. 7A, a sheet-shaped elastic member (polyurethane foam sheet or the like) that has been sliced to a target thickness is prepared. Then, as illustrated in FIG. 7A, a strip 108 having a target width and length is punched out of the sheet-shaped elastic member by using a punching die. The strip 108 has a projecting portion 110 (projection) that projects from an end portion of the strip 108 in the longitudinal direction at one side in the lateral direction.

The projecting portion 110 is provided so as to project in a direction that crosses the longitudinal direction at least at one of the end portions of the strip 108 in the longitudinal direction. The projecting portion 110 may be provided at each of the end portions of the strip 108. The shape of the projecting portion 110 is not particularly limited. The projecting portion 110 may be provided at each end portion the strip 108 in the longitudinal direction so to project in the direction that crosses the longitudinal direction at one or both sides of the end portion. The projecting portions 110 provided at both end portions of the strip 108 in the longitudinal direction may project in the opposite directions or in the same direction. Each projecting portion 110 may be shaped such that the thickness thereof gradually decreases toward the end thereof in the projecting direction. In this case, the end of the projecting portion 110 in the projecting direction may be pointed. The length of the projecting portion 110 may be greater than or equal to ½ of the circumference of the core 102.

The strip 108 may be easily wound around the core 102 at the end portions thereof when both end portions of the strip 108 in the longitudinal direction are provided with the projecting portions 110 and the projecting portions 110 provided at the end portions of the strip 108 project in the opposite directions along the direction that crosses the longitudinal direction of the strip 108. To further suppress the occurrence of unevenness in the image density, the length of the projecting portions 110 may be greater than or equal to ½ of the circumference of the core 102.

A double-sided adhesive tape that serves as the adhesive layer 106 (hereinafter referred to also as "double-sided adhesive tape 106") is bonded to one surface of the sheet-shaped elastic member. Thus, the strip 108 (strip-shaped elastic member with the double-sided adhesive tape 106) having a target width and length is obtained.

Next, as shown in FIG. 7B, the strip 108 is arranged such that the surface on which the double-sided adhesive tape 106 is attached faces upward. In this state, one end of the releasing paper of the double-sided adhesive tape 106 is detached, and an end portion of the core 102 is placed on the portion of the double-sided adhesive tape from which the releasing paper is detached.

Then, while detaching the releasing paper of the double-sided adhesive tape, the core 102 is rotated at a target speed so that the projecting portion 110 at one end of the strip 108 is wound around the outer peripheral surface of the end portion of the core 102. After the projecting portion 110 is wound, the elastic layer 104 is bonded to the outer peripheral surface of the core 102 such that the elastic layer 104 extends from one end to the other end of the core 102 in the axial direction of the core 102. Finally, the projecting portion (not shown) at the other end of the strip 108 is wound around the core 102. Thus, the cleaning member 100 including the elastic layer 104 having the central portion that extends from one end to the other end of the outer peripheral surface of the core 102 is obtained.

In the present exemplary embodiment, to suppress the restoring force of the strip 108 and prevent separation of the end portions of the strip 108 in the longitudinal direction from the core 102, the strip 108 may be arranged on the outer peripheral surface of the core 102 such that the elastic deformation of the strip 108 (variation in thickness in the central region in the width direction) is small. More specifically, the tension applied when the strip 108 is arranged on the outer peripheral surface of the core 102 may be controlled depending on the thickness of the strip 108.

Here, when the strip 108 that forms the elastic layer 104 is arranged on the outer peripheral surface of the core 102, the strip 108 may be placed on the core 102 such that the longitudinal direction of the strip 108 is at an angle of 3° or less (preferably 2° or less, more preferably 1° or less) with respect to the axial direction of the core 102. The outer diameter of the core 102 may be, for example, in the range from 2 mm to 12 mm.

In the case where a tension is applied to the strip 108 when the strip 108 is arranged on the outer peripheral surface of the core 102, the tension may be such that no gap is provided between the core 102 and the double-sided adhesive tape 106 on the strip 108. When the tension is too high, it becomes difficult to suppress the restoring force of the strip 108. In addition, the tensile permanent elongation increases, and the elastic force applied by the elastic layer 104 during cleaning tends to decrease. More specifically, the tension may be such that the length of the strip 108 is increased by 0% to 5% of the original length.

The strip 108 tends to expand when the strip 108 is arranged on the outer peripheral surface of the core 102. The amount of expansion differs depending on the position in the thickness D direction of the strip 108. The outermost portion tends to expand by a large amount, and accordingly the elastic force thereof may decrease. Therefore, the amount of expansion of the outermost portion of the strip 108 caused when the strip 108 is placed on the outer peripheral surface of the core 102 is preferably about 5% of the original length of the outermost portion of the strip 108.

The strip 108 may be subjected to a compressing process at the ends of the projecting portions 110 of the strip 108 in the projecting directions. In such a case, the thickness and elastic modulus are smaller than those in the case where the compressing process is not performed. Therefore, when the elastic layer 104 is formed of the strip 108 that has been subjected to the compressing process at the ends of the projecting portions 110 in the projecting direction, the restoring force applied to the end portions of the elastic layer 104 is reduced and separation of the elastic layer 104 from the core 102 is easily suppressed.

When the elastic layer 104 is formed of the strip 108 that has been subjected to the compressing process at the ends of the projecting portions 110 in the projecting direction, at least one of the end regions including the edges 111A and 113A of the first and second end portions 111 and 113 of the elastic layer 104 does not come into contact with the charging member 14. Therefore, the end regions may be the non-contact regions. In this case, the end of a portion that is not subjected to the compressing process in the at least one of the end regions including the edges 111A and 113A of the first and second end portions 111 and 113 of the elastic layer 104 is determined as the start point. Then, the rotation angle viewed from one side in the axial direction of the core 102 is observed by the above-described method.

Image Forming Apparatus etc.

An image forming apparatus according to the present exemplary embodiment will now be described with reference to the drawings.

Figure 8:
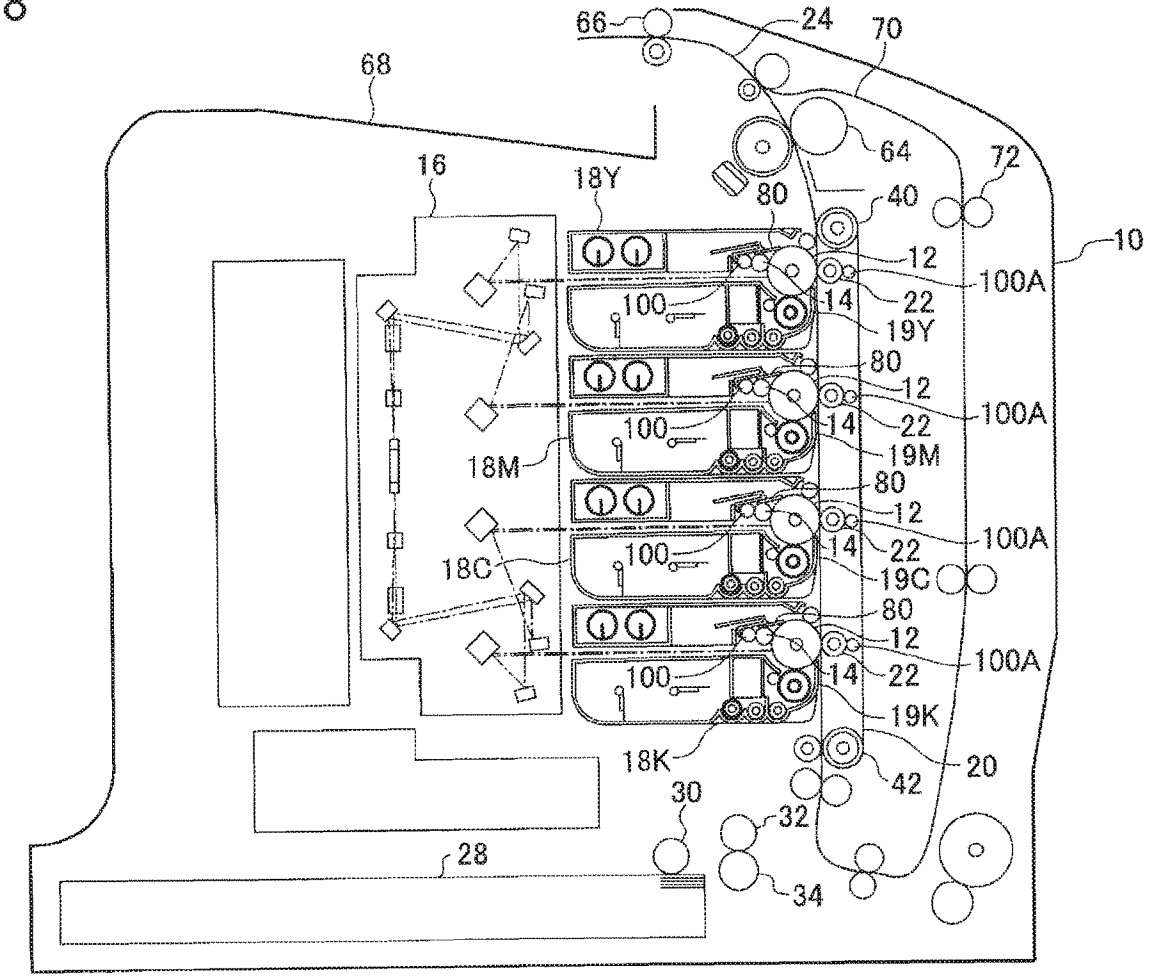
FIG. 8 is a schematic diagram illustrating an image forming apparatus according to the exemplary embodiment.

FIG. 8 is a schematic diagram illustrating an image forming apparatus 10 according to the present exemplary embodiment.

Figure 9:
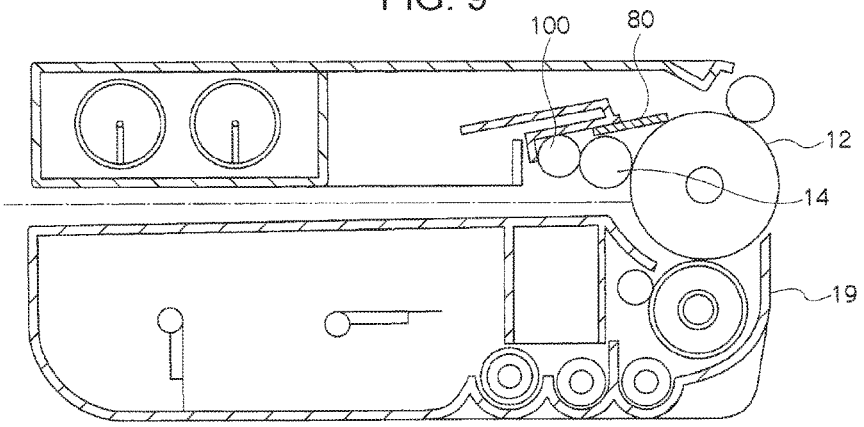
FIG. 9 is a schematic diagram illustrating a process cartridge according to the exemplary embodiment.

Referring to FIG. 8, the image forming apparatus 10 according to the present exemplary embodiment is, for example, a tandem color image forming apparatus. Process cartridges (see FIG. 9) for the respective colors, which are yellow (18Y), magenta (18M), cyan (18C), and black (18K), are disposed in the image forming apparatus 10 of the present exemplary embodiment. Each process cartridge includes a photoconductor (image carrier) 12, a charging member 14, and a developing device. The process cartridges are detachably attached to the image forming apparatus 10.

The photoconductor 12 includes, for example, a conductive cylindrical body having a diameter of 25 mm and a photoconductor layer made of an organic photosensitive or the like that covers the surface of the conductive cylindrical body. The photoconductor 12 is rotated at a process speed of, for example, 150 mm/sec by a motor (not shown).

The surface of the photoconductor 12 is charged by the charging member 14 disposed on the surface of the photoconductor 12, and is subjected to image exposure by a laser beam LB emitted from an exposure device 16 at a location downstream of the charging member 14 in the rotation direction of the photoconductor 12. Thus, an electrostatic latent image that corresponds to image information is formed on the surface of the photoconductor 12.

The electrostatic latent images formed on the photoconductors 12 are developed by developing devices 19Y, 19M, 19C, and 19K for yellow (Y), magenta (M), cyan (C), and black (K), respectively, so that toner images of the four colors are formed.

When, for example, a color image is to be formed, the surface of each of the photoconductors 12 for the respective colors is subjected to the charging, exposure, and developing processes corresponding to yellow (Y), magenta (M), cyan (C), or black (K). Accordingly, yellow (Y), magenta (M), cyan (C), and black (K) toner images are formed on the surfaces of the photoconductors 12 for the respective colors.

The yellow (Y), magenta (M), cyan (C), and black (K) toner images sequentially formed on the photoconductors 12 are transferred onto a recording sheet 24, which is transported to the outer peripheral surfaces of the photoconductors 12 by a sheet transport belt 20, at positions where the photoconductors 12 oppose transfer members 22 with the sheet transport belt 20 interposed therebetween. The sheet transport belt 20 is supported by supporting rolls 40 and 42 at the inner peripheral surface thereof while a tension is applied thereto. The recording sheet 24 that has received the toner images from the photoconductors 12 is transported to a fixing device 64. The toner images are fixed to the recording sheet 24 by being heated and pressed by the fixing device 64. Then, when printing is to be performed on only one side, the recording sheet 24 with the toner images fixed thereto is ejected onto an ejection unit 68 in the upper section of the image forming apparatus 10 by an ejection roller 66.

The recording sheet 24 is supplied from a sheet container 28 by a feed roller 30 and transported to the sheet transport belt 20 by transport rolls 32 and 34.

In the case where double-side printing is to be performed, the recording sheet 24 with the toner images fixed to a first surface (front surface) thereof by the fixing device 64 is not ejected onto the ejecting unit 68 by the ejection roller 66. Instead, the ejection roller 66 is rotated in the reverse direction while the rear end of the recording sheet 24 is held by the ejection roller 66, and the transport path of the recording sheet 24 is switched to a sheet transport path 70 for double-side printing. A transport roller 72 installed on the sheet transport path 70 for double-side printing transports the recording sheet 24 in the reversed state to the sheet transport belt 20 again, and toner images are transferred onto a second surface (rear surface) of the recording sheet 24 from the photoconductors 12. The toner images on the second surface (rear surface) of the recording sheet 24 are fixed by the fixing device 64, and the recording sheet (transfer-receiving member) is ejected onto the ejecting unit 68.

After the transferring of the toner images, cleaning blades 80 remove residual toner, paper dust, etc., from the surfaces of the photoconductors 12 to prepare for the next image formation every time the photoconductors 12 are rotated one turn. Each cleaning blade 80 is disposed on the surface of the corresponding photoconductor 12 at a position downstream of the position where the photoconductor 12 opposes the corresponding transfer member 22 in the rotation direction of the photoconductor 12.

As shown in FIG. 8, each transfer member 22 is, for example, a roller including a conductive core (not shown) and a conductive elastic layer (not shown) surrounding the conductive core. The conductive core is rotatably supported. A cleaning member 100A for cleaning the transfer member 22 is in contact with the transfer member 22 at a side opposite to the photoconductor 12. The transfer member 22 and the cleaning member 100A form a transfer device (unit). The cleaning member 100 according to the present exemplary embodiment (see FIG. 1) is used as the cleaning member 100A.

A case in which the cleaning member 100A is continuously in contact with the transfer member 22 and rotated by the transfer member 22 will be described herein. However, the cleaning member 100A may either be continuously in contact with the transfer member 22 and rotated by the transfer member 22, or be brought into contact with the transfer member 22 and rotated by the transfer member 22 only when the transfer member 22 is to be cleaned.

As shown in FIG. 10, the charging member 14 is, for example, a roller including a conductive core 14A and an elastic foam layer 14B surrounding the conductive core 14A. The conductive core 14A is rotatably supported. A cleaning member 100 for cleaning the charging member 14 is in contact with the charging member 14 at a side opposite to the photoconductor 12. The cleaning member 100 is part of a charging device (unit). The cleaning member according to the present exemplary embodiment is used as the cleaning member 100.

A case in which the cleaning member 100 is continuously in contact with the charging member 14 and rotated by the charging member 14 will be described herein. However, the cleaning member 100 may either be continuously in contact with the charging member 14 and rotated by the charging member 14, or be brought into contact with the charging member 14 and rotated by the charging member 14 only when the charging member 14 is to be cleaned.

A load F is applied to both ends of the conductive core 14A so that the charging member 14 is pressed against the photoconductor 12 and elastically deformed along the peripheral surface of an elastic foam layer 14B so as to form a nipping portion. In addition, a load F' is applied to both ends of the core 102 so that the cleaning member 100 is pressed against the charging member 14 and the elastic layer 104 is elastically deformed along the peripheral surface of the charging member 14 so as to form a nipping portion. Thus, the nipping portions that extend in the axial direction of the charging member 14 and the photoconductor 12 are formed while bending of the charging member 14 is suppressed.

The photoconductor 12 is rotated in the direction of arrow X by a motor (not shown), and the charging member 14 is rotated in the direction of arrow Y by the rotation of the photoconductor 12. The cleaning member 100 is rotated in the direction of arrow Z by the rotation of the charging member 14.

Structure of Charging Member

The charging member will now be described. However, the structure of the charging member is not limited by the following description.

The structure of the charging member is not particularly limited. For example, the charging member may include a core and an elastic foam layer or a resin layer instead of the elastic foam layer. The elastic foam layer may have a single-layer structure or a multilayer structure including plural layers having various functions. The elastic foam layer may be surface-treated.

The material of the core may be free-machining steel or stainless steel. The material and the surface treatment method may be selected as appropriate depending on the property such as slidability. The core may be plated. When an electrically non-conductive material is used, the material may be subjected to a typical process for imparting electrical conductivity, such as plating, or be used as is.

The elastic foam layer is a conductive elastic foam layer. The conductive elastic foam layer may contain, for example, an elastic material such as rubber, a conductive agent such as carbon black and an ion conductive agent for adjusting the resistance of the conductive elastic foam layer, and, as necessary, any additives commonly added to rubber, such as a softener, a plasticizer, a curing agent, a vulcanizing agent, a vulcanization accelerator, an antioxidant, and a filler such as silica or calcium carbonate. The elastic foam layer is formed by coating the peripheral surface of the conductive core with a mixture to which the materials commonly added to rubber are added. Examples of the conductive agent for adjusting the resistance include carbon black blended with a matrix material and a material in which an electrically conductive material that uses electrons and/or ions as charge carriers, such as an ion conductive material, is dispersed. The elastic material may be foamed.

The elastic material constituting the conductive elastic foam layer is formed by, for example, dispersing a conductive agent in a rubber material. Examples of the rubber material include silicone rubber, ethylene propylene rubber, epichlorohydrin-ethylene oxide copolymer rubber, epichlorohydrin-ethylene oxide-allyl glycidyl ether copolymer rubber, acrylonitrile-butadiene copolymer rubber, and blend rubber of these materials. These rubber materials may be foamed or unfoamed.

Examples of the conductive agent include electronic conductive agents and ion conductive agents. Examples of the electronic conductive agents include fine particles composed of carbon black such as Ketjen black and acetylene black; pyrolytic carbon and graphite; various conductive metals such as aluminum, copper, nickel, and stainless steel and alloys thereof; conductive metal oxides such as tin oxide, indium oxide, titanium oxide, tin oxide-antimony oxide solid solution, and tin oxide-indium oxide solid solution; and insulating materials having surfaces subjected to a conductivity imparting treatment. Examples of the ion conductive agent include perchlorates and chlorates of oniums such as tetraethylammonium and lauryltrimethylammonium; and perchlorates and chlorates of alkali metals and alkaline earth metals such as lithium and magnesium.

These conductive agents may be used alone or in combination of two or more. The amounts of these conductive agents added are not particularly limited. The amount of the electronic conductive agent may be 1 to 60 parts by weight relative to 100 parts by weight of rubber material. The amount of the ion conductive agent may be 0.1 to 5.0 parts by weight relative to 100 parts by weight of rubber material.

A surface layer may be formed in the surface of the charging member. The material of the surface layer may be resin, rubber, etc., and is not particularly limited. For example, polyvinylidene fluoride, ethylene tetrafluoride copolymers, polyester, polyimide, and copolymer nylon may be used.

Examples of the copolymer nylon include those that contain at least one of nylon 6,10, nylon 11, and nylon 12 as a polymerization unit. Examples of other polymerization unit contained in the copolymer include nylon 6 and nylon 6,6. The ratio of a polymerization unit constituted by nylon 6,10, nylon 11, and/or nylon 12 in the copolymer may be 10% by weight or more in total.

The polymer materials may be used alone or in combination of two or more. The number-average molecular weight of the polymer material is preferably 1,000 to 100,000 and more preferably 10,000 to 50,000.

A conductive material may be added to the surface layer to control the resistance. The conductive material may have a particle size of 3 μm or less.

Examples of the conductive agent for adjusting the resistance include carbon black and conductive metal oxide particles blended with a matrix material, and a material in which an electrically conductive material that uses electrons and/or ions as charge carriers, such as an ion conductive material, is dispersed.

Examples of carbon black used as a conductive agent include Special Black 350, Special Black 100, Special Black 250, Special Black 5, Special Black 4, Special Black 4A, Special Black 550, Special Black 6, Color Black FW200, Color Black FW2, and Color Black FW2V produced by Orion Engineered Carbons, and MONARCH 1000, MONARCH 1300, MONARCH 1400, MOGUL-L, and REGAL 400R produced by Cabot Corporation.

Carbon black may have a pH of 4.0 or less.

The conductive metal oxide particles used as conductive particles for adjusting the resistance are not particularly limited, and any conductive agents may be used as long as electrons are used as charge carriers. For example, conductive particles of tin oxide, antimony-doped tin oxide, zinc oxide, anatase-type titanium oxide, or indium tin oxide (ITO) may be used. These materials may be used alone or in combination of two or more, and may have any particle size. Preferably, tin oxide, antimony-doped tin oxide, or anatase-type titanium oxide is used. More preferably, tin oxide or antimony-doped tin oxide is used.

The surface layer may be made of a fluorine-based or silicone-based resin. In particular, the surface layer may be made of a fluorine-modified acrylate polymer. Particles may be added to the surface layer. Insulating particles such as alumina or silica particles may be added to form recesses in the surface of the charging member so that the frictional load imposed during contact with the photoconductor is decreased and the wear resistance between the charging member and the photoconductor is improved.

The outer diameter of the charging member may be in the range from 8 mm to 16 mm. The outer diameter is measured by using a commercially available caliper or a laser outer-diameter measuring device.

The microhardness of the charging member may be in the range from 45° to 60°. The hardness may be reduced by increasing the amount of plasticizer added or using a low-hardness material such as silicone rubber.

The microhardness of the charging member may be measured by using MD-1 hardness meter produced by Kobunshi Keiki Co., Ltd.

The image forming apparatus of the present exemplary embodiment includes process cartridges each including a photoconductor (image carrier), a charging device (unit constituted by a charging member and a cleaning member), a developing device, and a cleaning blade (cleaning device). However, the image forming apparatus is not limited to this, and each process cartridge may instead include a charging device (unit constituted by a charging member and a cleaning member) and one or more selected from a photoconductor (image carrier), an exposing device, a transfer device, a developing device, and a cleaning blade (cleaning device) as necessary. Alternatively, each process cartridge may include a transfer device (unit constituted by a transfer member and a cleaning member) and one or more selected from a photoconductor (image carrier), an exposing device, a charging device, a developing device, and a cleaning blade (cleaning device) as necessary. It should be noted that these devices and members need not be formed into a cartridge and may be directly installed in the image forming apparatus.

In the image forming apparatus of the present exemplary embodiment, the charging device is a unit constituted by the charging member and the cleaning member, and the transfer device is a unit constituted by the transfer member and the cleaning member. In other words, the charging member and the transfer member are the members to be cleaned. However, the member to be cleaned is not limited to this, and may instead be a photoconductor (image carrier), a transfer device (transfer transport belt or sheet transport belt), an intermediate-transferring-type second transfer device (second transfer member or second transfer roller), or an intermediate transfer member (intermediate transfer belt). The unit constituted by the member to be cleaned and the cleaning member in contact with the member to be cleaned may be directly installed in the image forming apparatus or may be formed into a cartridge as with the above-described process cartridge and installed in the image forming apparatus.

The structure of the image forming apparatus of the present exemplary embodiment is not limited to the above-described structure. Image forming apparatuses of an intermediate transfer type and other known types may be employed.

EXAMPLES

The present invention will now be described by using Examples. However, the present invention is not limited by Examples described below.

Example 1

Preparation of Cleaning Roller 1

A strip having rectangular projecting portions at both ends thereof is cut out of a sheet made of urethane foam (EP-70 produced by Inoac Corporation) having a thickness of 2.5 mm as an elastic member. Next, a double-sided adhesive tape (4801-015 produced by Sumitomo 3M Limited) having a thickness of 0.15 mm is attached to the entire surface of the prepared strip such that the centers thereof in the width direction coincide. Thus, a strip with a double-sided adhesive tape is obtained. The strip with the double-sided adhesive tape is placed on a horizontal table so that the releasing paper attached to the double-sided adhesive tape faces downward, and is bonded to a metal core (overall length 236 mm, core diameter 4 mm, and core circumference 12.56 mm) made of nickel-plated free-machining steel while a tension is applied to the strip so that the overall length of the strip is increased by 0% to 5%. Thus, a cleaning roller 1 (cleaning member) including an elastic layer disposed so as to extend from one end to the other end of the metal core is obtained. The elastic layer is formed such that the circumferential cover length at the first end portion, the circumferential cover length at the second end portion, the circumferential cover length at the central portion, the rotation angle viewed from one side in the axial direction of the core (angle of non-contact region), and the angle relative to the axial direction of the core are as shown in Table 2, and such that the metal core is exposed over a length of 6 mm at both ends.

Examples 2-5 and 7-13 and Comparative Examples 1-4

Preparation of Cleaning Rollers 2-5 and 7-13 and Comparative Cleaning Rollers 1-4

Cleaning rollers 2-5 and 7-13 and comparative cleaning rollers 1-4 are prepared in a manner similar to cleaning roller 1 except that the circumferential cover length at the first end portion, the circumferential cover length at the second end portion, the circumferential cover length at the central portion, the rotation angle viewed from one side in the axial direction of the core (angle of non-contact region), the core diameter, and the angle relative to the axial direction of the core are set to values shown in Table 2.

Example 6

Preparation of Cleaning Roller 6

Cleaning roller 6 is prepared in a manner similar to cleaning roller 2 except that the elastic member is made of melamine foam (Basotect W produced by BASF).

Example 14

Preparation of Cleaning Roller 14

Cleaning roller 14 is prepared in a manner similar to cleaning roller 1 except that two elastic bodies are disposed at opposing positions separated from each other by 180° and that the circumferential cover length at the first end portion, the circumferential cover length at the second end portion, the circumferential cover length at the central portion, the rotation angle viewed from one side in the axial direction of the core (angle of non-contact region), and the angle relative to the axial direction of the core are set to values shown in Table 2.

Evaluation

The prepared cleaning rollers are evaluated in terms of the following performance, which will be described below, and image quality. For the evaluation, the following charging roller is used.

Preparation of Charging Roller

Preparation of Elastic Roller

A mixture having the composition shown in Table 1 is kneaded with an open roll, and a conductive elastic layer is formed on an outer peripheral surface of a conductive core, which is composed of a metal core made of nickel-plated free-machining steel and has a diameter of 6 mm and an overall length of 240 mm, with an adhesive layer interposed therebetween by using a press. The conductive elastic layer has an outer diameter of 10 mm and a length of 224 mm. Then, the roller is polished until the outer diameter thereof is reduced to 9.0 mm. Thus, an elastic roller having a conductive elastic layer is formed.

TABLE 1

| Material Type | | Blending Ratio (Parts by Weight) |
|---|---|---|
| Rubber | Epichlorohydrin Rubber (Hydrin T3106/Zeon Corporation) | 100 |
| Conductive | Carbon Black (#55/Asahi Carbon Co., Ltd.) | 20 |
| Agent | Benzyltriethylammonium Chloride (Kanto Chemical Co., Inc.) | 1 |
| Vulcanizing Agent | Sulfur (Sulfax PS/Tsurumi Chemical Industries Co., Ltd.) | 0.5 |
| Vulcanization | Tetramethylthiuram Disulfide (Nocceler TT/ | 1.5 |
| Accelerator | Ouchi Shinko Chemical Industrial Co., Ltd.) | |
| | Dibenzothiazyl Disulfide (Nocceler DM/ Ouchi Shinko Chemical Industrial Co., Ltd.) | 1.5 |
| Auxiliary Vulcanization Accelerator | Zinc Oxide (Zinc Oxide Type I/Seido Chemical Industry Co., Ltd.) | 5 |
| Filler | Calcium Carbonate (Silver W/Shiraishi Kogyo Kaisha, Ltd.) | 20 |
| Slip Agent | Stearic Acid (Kanto Chemical Co., Inc.) | 1 |

Formation of Surface Layer

A liquid in which the mixture described below is dispersed with a bead mill is diluted with methanol, applied to a surface of the conductive elastic layer by dip-coating, and thermally dried at 140° C. for 15 minutes to form a surface layer having a thickness of 10 μm. Thus, a charging roller was obtained.

Polymeric Material 100 parts by weight (Copolymer Nylon, Amilan CM8000 produced by Toray Industries, Inc.)

Conductive Agent 60 parts by weight (Antimony-Doped Tin Oxide, SN-100P produced by Ishihara Sangyo Kaisha, Ltd.)

Solvent (Methanol) 500 parts by weight

Solvent (Butanol) 240 parts by weight

Evaluation

Evaluation of Following Performance

Each cleaning roller is mounted in a device in which the cleaning roller is pressed against the prepared charging roller so as to cause a deformation of 0.5 mm and is rotated by the charging roller. The charging roller is rotated at 950 rpm, which corresponds to a linear velocity of about 450 mm/s, and the number of revolutions of the cleaning roller that is contact with the charging roller is measured by a non-contact tachometer. The following performance is evaluated by using the criteria described below. The result of the evaluation is shown in Table 2.

Evaluation Criteria for Following Performance

G1: Value in the range from 95% to 100% of the theoretical number of revolutions per minute of the cleaning roller.

G2: Value in the range of 90% or more and less than 95% of the theoretical number of revolutions per minute of the cleaning roller.

G3: Value in the range of 80% or more and less than 90% of the theoretical number of revolutions per minute of the cleaning roller.

G4: Value in the range of less than 80% of the theoretical number of revolutions per minute of the cleaning roller.

Evaluation of Image Quality

DocuPrint CD400-dP450 JM produced by Fuji Xerox Co., Ltd. is converted so that the charging roller is rotated at 1000 rpm, which corresponds to a linear velocity of about 470 mm/s. The charging roller and each of the cleaning rollers prepared as described above are mounted in a process cartridge for DocuPrint CD400-dP450 JM. Fifty thousand images are continuously formed at 28° C. and 85% RH, and then fifty thousand images are continuously formed at 10° C. and 15% RH. After the continuous image forming operation, a halftone image having an image density of 50% is formed on an A4-size paper sheet (C2 paper produced by Fuji Xerox Co., Ltd.) at 10° C. and 15% RH, and whether density unevenness has occurred is visually evaluated. The evaluation result is shown in Table 2.

Evaluation Criteria for Image Quality

G1: Density unevenness does not occur

G2: Very slight density unevenness occurs

G3: Slight density unevenness occurs (between G2 and G4)

G4: Density unevenness occurs

Evaluation Regarding Separation

Each of the cleaning rollers of Examples and Comparative Examples is retained by a jig capable of holding both ends of the core while the elastic layer is not in contact with anything, and is left for a month in an environment where the temperature is 45° C. and the relative humidity is 95%, and then for a month in an environment where the temperature is 10° C. and the relative humidity is 15%.

After two months in total, evaluation is performed by using the evaluation criteria described below. The evaluation result is shown in Table 2.

Evaluation Criteria

G1: No separation occurs.

G2: Small separation occurs at the corners of one end or both ends in the longitudinal direction, but no problem occurs when the cleaning roller is used.

G3: After two months, separation that causes a problem when the cleaning roller is used occurs at the corners of one end or both ends in the longitudinal direction (amount of separation from the core is 0.3 mm or more at one end or both ends of the longitudinal direction).

TABLE 2

| | | Example 1 | Example 2 | Example 3 | Example 4 | Example 5 | Example 6 | Example 7 | Example 8 | Example 9 | Example 10 |
|---|---|---|---|---|---|---|---|---|---|---|---|
| Core Diameter (mm) | | 4 | 4 | 4 | 4 | 4 | 4 | 4 | 4 | 4 | 4 |
| Core Circumference (mm) *1 | | 12.56 | 12.56 | 12.56 | 12.56 | 12.56 | 12.56 | 12.56 | 12.56 | 12.56 | 12.56 |
| ½ Core Circumference (mm) | | 6.28 | 6.28 | 6.28 | 6.28 | 6.28 | 6.28 | 6.28 | 6.28 | 6.28 | 6.28 |
| Circumferential Cover Length at First End Portion (mm) | | 6.28 | 6.28 | 6.28 | 6.28 | 9.42 | 6.28 | 6.28 | 6.28 | 6.28 | 6.28 |
| Circumferential Cover Length at Second End Portion (mm) | | 5.76 | 5.93 | 6.11 | 6.28 | 9.42 | 5.93 | 6.28 | 6.28 | 6.28 | 6.28 |
| Circumferential Cover Length at Central Portion (mm) | | 3 | 3 | 3 | 3 | 3 | 3 | 3 | 3 | 3 | 1 |
| Angle of Non-Contact Region (°) | | 15 | 10 | 5 | 0 | 0 | 10 | 0 | 0 | 0 | 0 |
| Angle Relative to Axial Direction of Core (°) | | 0 | 0 | 0 | 0 | 0 | 0 | 3 | 2 | 1 | 0 |
| Winding Number | | 0 | 0 | 0 | 0 | 0 | 0 | 1 or less | 1 or less | 1 or less | 0 |
| Material of Elastic Member | | Urethane Foam | Urethane Foam | Urethane Foam | Urethane Foam | Urethane Foam | Melamine Foam | Urethane Foam | Urethane Foam | Urethane Foam | Urethane Foam |
| Evaluation Result | Following Performance | G3 | G2 | G2 | G1 | G1 | G2 | G1 | G1 | G1 | G1 |
| | Density Unevenness | G3 | G2 | G1 | G1 | G1 | G3 | G2 | G2 | G1 | G3 |
| | Separation | G1 | G1 | G1 | G1 | G1 | G1 | G1 | G1 | G1 | G2 |

| | | Example 11 | Example 12 | Example 13 | Example 14 | Comparative Example 1 | Comparative Example 2 | Comparative Example 3 | Comparative Example 4 |
|---|---|---|---|---|---|---|---|---|---|
| Core Diameter (mm) | | 4 | 4 | 6 | 8 | 4 | 4 | 4 | 4 |
| Core Circumference (mm) *1 | | 12.56 | 12.56 | 18.84 | 25.12 | 12.56 | 12.56 | 12.56 | 12.56 |
| ½ Core Circumference (mm) | | 6.28 | 6.28 | 9.42 | 12.56 | 6.28 | 6.28 | 6.28 | 6.28 |
| Circumferential Cover Length at First End Portion (mm) | | 6.28 | 6.11 | 9.43 | 12.04 | 5.93 | 6.28 | 5.93 | 7 |
| Circumferential Cover Length at Sercond End Portion (mm) | | 6.28 | 6.11 | 9.43 | 11.04 | 5.93 | 5.23 | 5.93 | 7 |
| Circumferential Cover Length at Central Portion (mm) | | 5 | 2 | 5 | 1 | 3 | 3 | 2 | 7 |
| Angle of Non-Contact Region (°) | | 0 | 10 | 0 | 15 | 20 | 30 | 20 | 160 |
| Angle Relative to Axial Direction of Core (°) | | 0 | 0 | 0 | 0 | 0 | 0 | 6.5 | 0 |
| Winding Number | | 0 | 0 | 0 | 0 | 0 | 0 | 2 | 0 |
| Material of Elastic Member | | Urethane Foam | Urethane Foam | Urethane Foam | Urethane Foam | Urethane Foam | Urethane Foam | Urethane Foam | Urethane Foam |
| Evaluation Result | Following Performance | G1 | G2 | G1 | G1 | G4 | G4 | G4 | G4 |
| | Density Unevenness | G1 | G3 | G1 | G2 | G4 | G4 | G4 | G4 |
| | Separation | G2 | G1 | G1 | G1 | G1 | G1 | G1 | G3 |

*1: circumferential cover length (mm) is calculated by using 3.14 as the circular constant The above result shows that the image qualities of Examples are better than those of Comparative Examples.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A cleaning member comprising:

a core extending in an axial direction; and an elastic layer disposed on an outer peripheral surface of the core so as to extend from one axial end to another axial end of the core, wherein the elastic layer comprises a first projection and a second projection, the first projection and the second projection projecting in a radial direction of the core, wherein the first projection is provided at a first end of the elastic layer in the axial direction, wherein the second projection is provided at a second end of the elastic layer in the axial direction, wherein the cleaning member is configured such that, when the cleaning member is rotated by a member to be cleaned, a non-contact region in which the first end and the second end are not in contact with the member to be cleaned is in a range from approximately 0° to approximately 15° in terms of a rotation angle of the cleaning member viewed from one side in the axial direction of the core, and wherein a circumferential cover length over which the elastic layer covers the core in a circumferential direction is less than or equal to approximately ½ of a circumference of the core at a center of the core in the axial direction.

2. The cleaning member according to claim 1, wherein the non-contact region in which the first end and the second end are not in contact with the member to be cleaned is in a range from approximately 0° to approximately 10° in terms of the rotation angle of the cleaning member viewed from the one side in the axial direction of the core.

3. The cleaning member according to claim 1, wherein the non-contact region in which the first end and the second end are not in contact with the member to be cleaned is in a range from approximately 0° to approximately 5° in terms of the rotation angle of the cleaning member viewed from the one side in the axial direction of the core.

4. The cleaning member according to claim 1, wherein the circumferential cover length over which the elastic layer covers the core in the circumferential direction is greater than or equal to approximately ½ of the circumference of the core at least at one of the first end and the second end in the axial direction.

5. The cleaning member according to claim 4, wherein the circumferential cover length over which the elastic layer covers the core in the circumferential direction is greater than or equal to approximately ½ of the circumference of the core at both of the first end and the second end in the axial direction.

6. The cleaning member according to claim 1, wherein the circumferential cover length over which the elastic layer covers the core in the circumferential direction is less than or equal to approximately ⅓ of the circumference of the core at the center of the core in the axial direction.

7. The cleaning member according to claim 1, wherein the circumferential cover length over which the elastic layer covers the core in the circumferential direction is less than or equal to approximately ¼ of the circumference of the core at the center of the core in the axial direction.

8. A process cartridge comprising:

a charging device including a charging member configured to charge an object to be charged, and the cleaning member according to claim 1 that is in contact with a surface of the charging member and that is configured to clean the surface of the charging member, wherein the process cartridge is detachably attached to an image forming apparatus.

9. A transfer device comprising:

a transfer member configured to transfer an object to be transferred onto a transfer-receiving member, and the cleaning member according to claim 1 that is in contact with a surface of the transfer member and that is configured to clean the surface of the transfer member.

10. An image forming apparatus comprising:

an electrophotographic photoconductor;

a charging device including a charging member configured to charge a surface of the electrophotographic photoconductor, and the cleaning member according to claim 1 that is in contact with a surface of the charging member and that is configured to clean the surface of the charging member;

an electrostatic-latent-image forming device configured to form an electrostatic latent image on the charged surface of the electrophotographic photoconductor;

a developing device configured to form a toner image by developing the electrostatic latent image formed on the surface of the electrophotographic photoconductor by using developer containing toner; and a transfer device configured to transfer the toner image onto a surface of a recording medium.

11. An image forming apparatus comprising:

an electrophotographic photoconductor;

a charging device configured to charge a surface of the electrophotographic photoconductor;

an electrostatic-latent-image forming device configured to form an electrostatic latent image on the charged surface of the electrophotographic photoconductor;

a developing device configured to form a toner image by developing the electrostatic latent image formed on the surface of the electrophotographic photoconductor by using developer containing toner; and a transfer device including a transfer member configured to transfer the toner image onto a surface of a recording medium, and the cleaning member according to claim 1 that is in contact with a surface of the transfer member and is configured to clean the surface of the transfer member.

* * * * *